US006827550B2

(12) United States Patent
Okudera et al.

(10) Patent No.: US 6,827,550 B2
(45) Date of Patent: Dec. 7, 2004

(54) VACUUM PUMP

(75) Inventors: Satoshi Okudera, Narashino (JP); Takashi Kabasawa, Narashino (JP); Tooru miwata, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 0 days.

(21) Appl. No.: 10/387,077

(22) Filed: Mar. 12, 2003

(65) Prior Publication Data

US 2003/0175114 A1 Sep. 18, 2003

(30) Foreign Application Priority Data

Mar. 12, 2002 (JP) ..... 2002-066793

(51) Int. Cl.[7] ..... F04D 19/04
(52) U.S. Cl. ..... 415/72; 415/199.5; 415/173.1
(58) Field of Search ..... 415/72, 90, 199.5, 415/173.1, 220

(56) References Cited

U.S. PATENT DOCUMENTS 4,732,529 A * 3/1988 Narita et al. ..... 415/90
4,797,062 A * 1/1989 Deters et al. ..... 415/90
6,343,910 B1 * 2/2002 Kawasaki et al. ..... 415/90

* cited by examiner

*Primary Examiner*—Ninh H. Nguyen
(74) *Attorney, Agent, or Firm*—Adams & Wilks

(57) ABSTRACT

A vacuum pump adopts a positioning structure in which stator blades and spacers are arranged in the radial direction of a pump case by the contact between the outer peripheries portion of the stator blades and the inner periphery portion of the pump case and the contact between the outer periphery portions of the spacers and the inner periphery portion of the pump case. Accordingly, the spacer interposed between the upper and lower stator blades can have a simplified shape that serves a function of only setting the spacing between the stator blades to a prescribed length, thus decreasing the number of steps and costs of processing the spacer, and accordingly reducing the costs of the entire vacuum pump.

16 Claims, 6 Drawing Sheets

PRIOR ART

PRIOR ART

VACUUM PUMP

BACKGROUND OF THE INVENTION

1. Field of the Invention

The present invention relates to a vacuum pump used in semiconductor manufacturing apparatus, an electron microscope, a surface analysis apparatus, a mass spectrograph, a particle accelerator, a nuclear fusion experiment apparatus, and so on.

2. Description of the Related Art

When the turbo molecular pump was first developed as a high vacuum pump, there were only full-blade turbo molecular pumps with a blade structure in which the rotor blades are integrated over the entire outer periphery of the rotor. The full-blade turbo molecular pumps, however, have rotor blades with excessive resistance in a low vacuum area, and it was difficult to operate the pump normally. Therefore, improved vacuum pumps using a combination of a turbo molecular pump and a thread groove pump (hereinafter, referred to as a composite vacuum pump) have been developed.

This type of composite vacuum pump includes a rotor 9 which is rotatably disposed in a cylindrical pump case 1, substantially the upper half of which functions as a turbo molecular pump and substantially the lower half of which functions as a thread groove pump, as shown in FIG. 5.

In this type of composite vacuum pump, the part that functions as a turbo molecular pump includes multiple-stage rotor blades 10 arranged on the outer periphery of the rotor 9 and multiple-stage stator blades 11 alternating with the rotor blades 10. With this arrangement, the upper- and lower-stage stator blades 11, which are placed a prescribed distance apart from each other, are positioned and arranged in a radial direction of the pump case 1.

The spacing and arrangement in the radial direction between the stator blades 11 of both the full-blade type and the composite vacuum pumps are performed through multistage ring-shaped spacers 60 which are arranged at the inner periphery of the pump case 1. The spacers 60 employ a structure in which the upper and lower spacers 60 and 60 are in engagement with each other in a stack so that lateral misalignment of the spacers 60 can be prevented during the stacking operation in the pump assembly process and the upper and lower spacers 60 and 60 can be arranged in a radial direction of the pump case 1 in the same manner. More specifically, as shown in FIG. 6, the spacers 60 employ a stacked and locked structure in which upper and lower steps 61*a* and 61*b* arranged on the inner and outer peripheries thereof, respectively, are in engagement with each other.

The spacer 60, however, is one thin part among the components of the vacuum pump, and it thus becomes deformed easily. Particularly, the related-art spacer 60 having the steps 61*a* and 61*b* is thin in most part. Therefore, it becomes deformed more easily and is difficult to process, which leads to an increased cost for the entire pump.

SUMMARY OF THE INVENTION

The present invention has been made to solve the above problems. Accordingly, it is an object of the present invention to provide a vacuum pump suitable for reducing the overall pump cost.

In order to achieve the above object, a vacuum pump according to the present invention includes a cylindrical pump case; a rotatable rotor arranged inside the pump case; multistage rotor blades arranged at the upper outer periphery of the rotor; multistage stator blades arranged alternately with the rotor blades at the inner periphery of the pump case; a screw stator shaped to surround the lower outer periphery of the rotor; and ring-shaped spacers placed around the inner periphery of the pump case and interposed between the upper and lower stator blades; wherein the stator blades and the spacers are arranged in the radial direction of the pump case by the contact between the outer periphery portions of the stator blades and the outer periphery portions of the spacers.

According to the invention, with such an arrangement, spacers having a simplified shape that functions only to set the spacing between the stator blades to a prescribed distance.

According to the invention, the walls of the ring-shaped spacers may be rectangular in cross section.

Furthermore, the inner periphery portion of the pump case may form a straight inner cylindrical surface and the outer periphery portion of the stator blades in contact with the inner periphery portion of the pump case and the outer periphery portion of the spacers may form a straight outer cylindrical surface having a diameter equal to each other to be fitted in the inner cylindrical surface of the pump case.

Furthermore, the outer periphery portion of the screw stator may form a straight outer cylindrical surface of a diameter equal to the diameter of the outer cylindrical surfaces of the stator blades and the spacers and may be fitted in the inner periphery portion of the pump case; and the spacer placed most distant from the screw stator may be in contact with the step at the inner cylindrical surface of the pump case to position the spacer and the screw stator along the rotor shaft.

A vacuum pump according to the invention includes a cylindrical pump case; a rotatable rotor arranged inside the pump case; multistage rotor blades arranged at the upper outer periphery of the rotor; multistage stator blades arranged alternately with the rotor blades at the inner periphery of the pump case; a screw stator shaped to surround the lower outer periphery of the rotor; and ring-shaped spacers placed around the inner periphery of the pump case and interposed between the upper and lower stator blades and each having a contact portion for positioning the stator blades in the radial direction of the pump case by the contact with the outer periphery portion of the stator blades; wherein the spacers are arranged in the radial direction of the pump case by the contact between the outer periphery portion of the spacers and the inner periphery portion of the pump case.

In the vacuum pump according to the invention, the spacers may be arranged apart from each other by sandwiching one stator blade between the adjacent spacers, and the outer periphery portion of the spacers may form a straight outer cylindrical surface, at least one end surface thereof forming a plane perpendicular to the outer cylindrical surface.

With such an arrangement, the invention can adopt spacers with a relatively simplified shape having only a function of setting the spacing between the stator blades to a prescribed distance and a function of arranging the stator blades in the radial direction of the pump case.

BRIEF DESCRIPTION OF THE DRAWINGS

FIGS. 4A and 4B are explanatory views of an integral stator blade, wherein FIG. 4A is a plan view of the integral stator blade and FIG. 4B is a cross-sectional view of the blade of FIG. 4A seen from arrow A;

DESCRIPTION OF THE PREFERRED EMBODIMENTS

Figure 1:
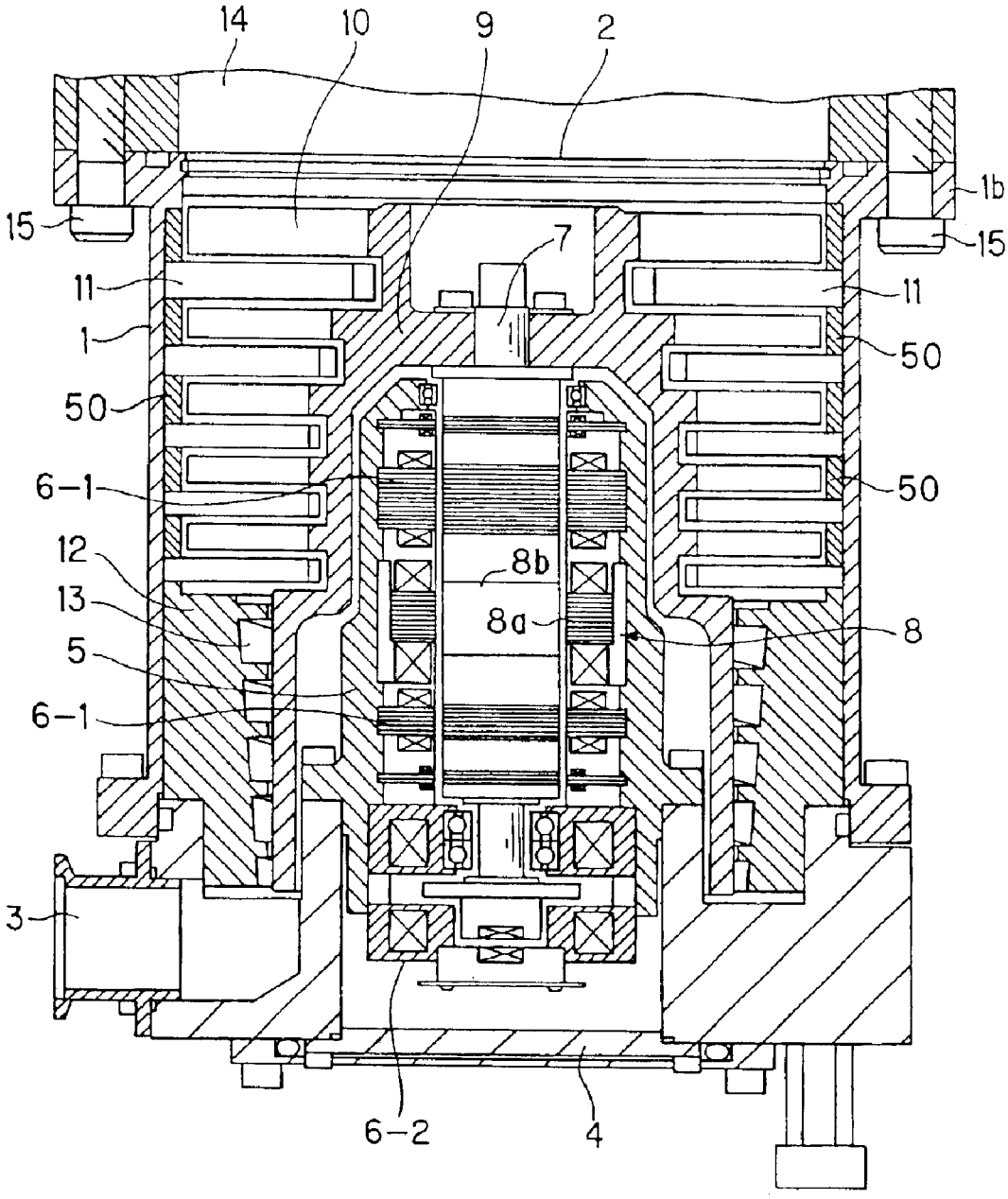
FIG. 1 is a cross-sectional view of an embodiment of a vacuum pump according to the present invention.
Figure 2:
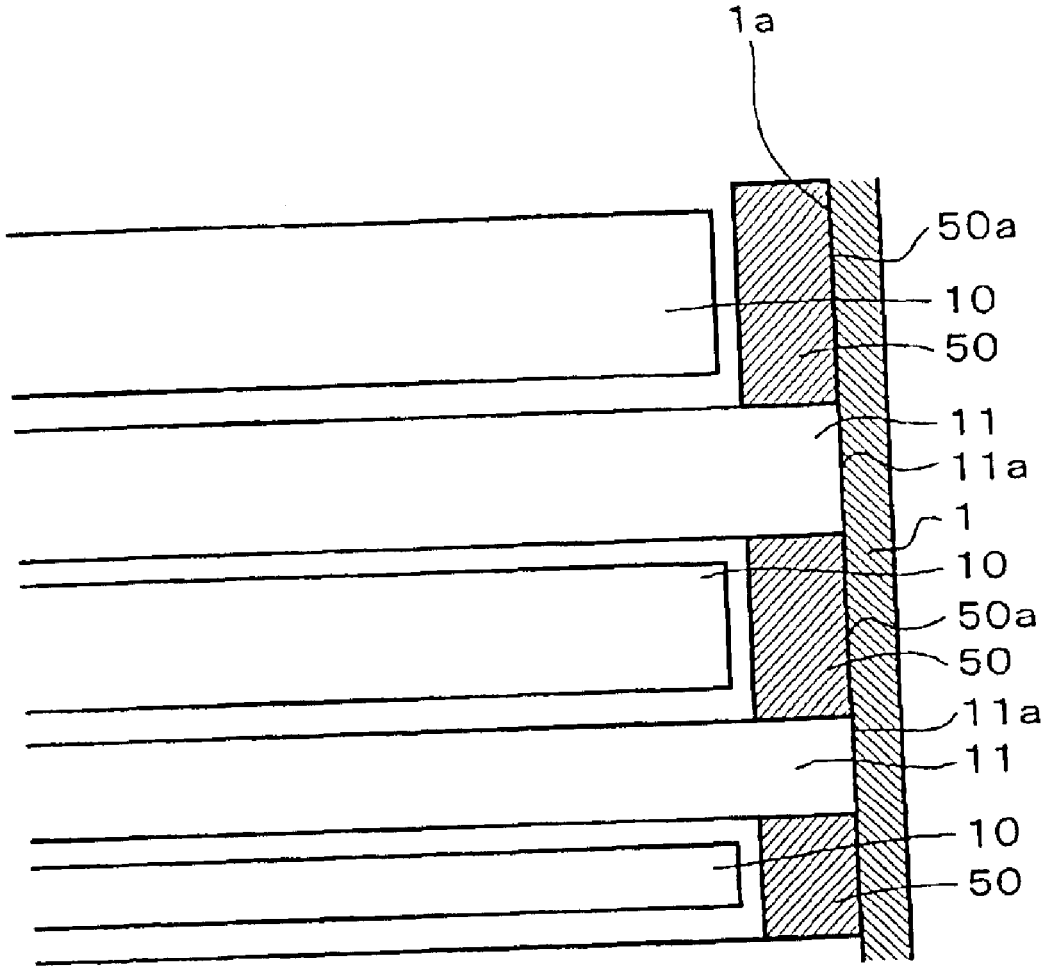
FIG. 2 is an enlarged view of the periphery of spacers of the vacuum pump shown in FIG. 1.
Figure 3:
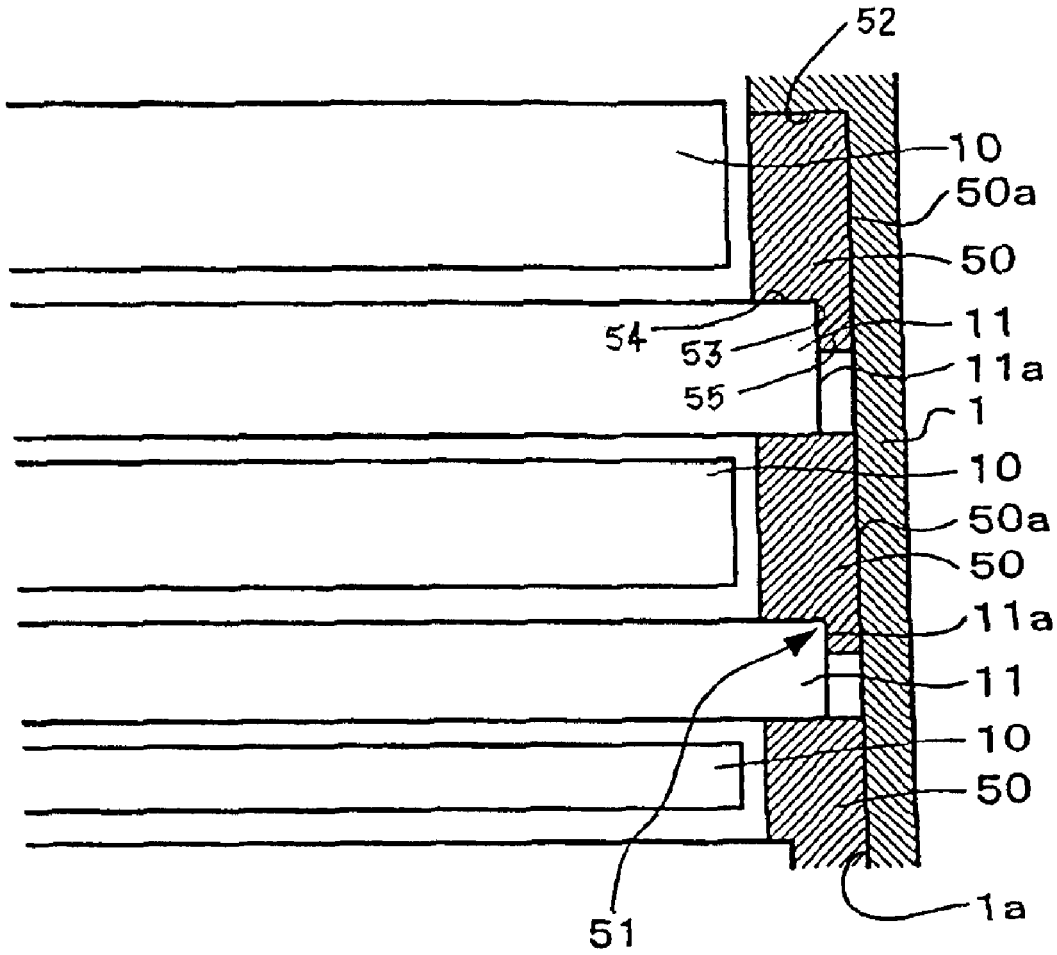
FIG. 3 is an explanatory view of another embodiment of the spacer in the vacuum pump shown in FIG. 1.

Referring to FIGS. 1 to 3, an embodiment of a vacuum pump according to the present invention will be specifically described hereinafter.

FIG. 1 shows a composite vacuum pump, which is a combination of a turbo molecular pump and a thread groove pump. A pump case 1 of the vacuum pump is a cylindrically shaped case with a bottom surface, and it has an opening which serves as a gas inlet 2 at the top and an exhaust pipe which serves as an exhaust port 3 projecting from one end of the lower part.

The bottom of the pump case 1 is covered with an end plate 4, and a stator column 5 extends upright from the center of the inner bottom surface.

The stator column 5 has a rotatable rotor shaft 7 at the center thereof, and the rotor shaft 7 is supported in the radial and axial directions thereof by a magnetic bearing having a radial electromagnet 6-1 and an axial electromagnet 6-2 provided in the stator column 5.

A drive motor 8 is provided inside the stator column 5. The drive motor has a stator element 8*a* inside the stator column 5 and a rotor element 8*a* on the rotor shaft 7, which is rotated around the shaft center.

The pump case 1 contains a rotor 9 having a cross section covering the outer periphery of the stator column 5, the rotor 9 being connected to an upper protrusion of the stator column 5 of the rotor shaft 7.

The rotor 9 has multiple-stage rotor blades 10 fixed to the upper outer periphery thereof, and multiple-stage stator blades 11 are arranged alternately with the rotor blades 10 and fixed to the inner periphery of the pump case 1.

The rotor blades 10 and the stator blades 11 are arranged radially around the pump shaft center (the rotor shaft 7 or the shaft center of the pump case 1).

Figure 4:
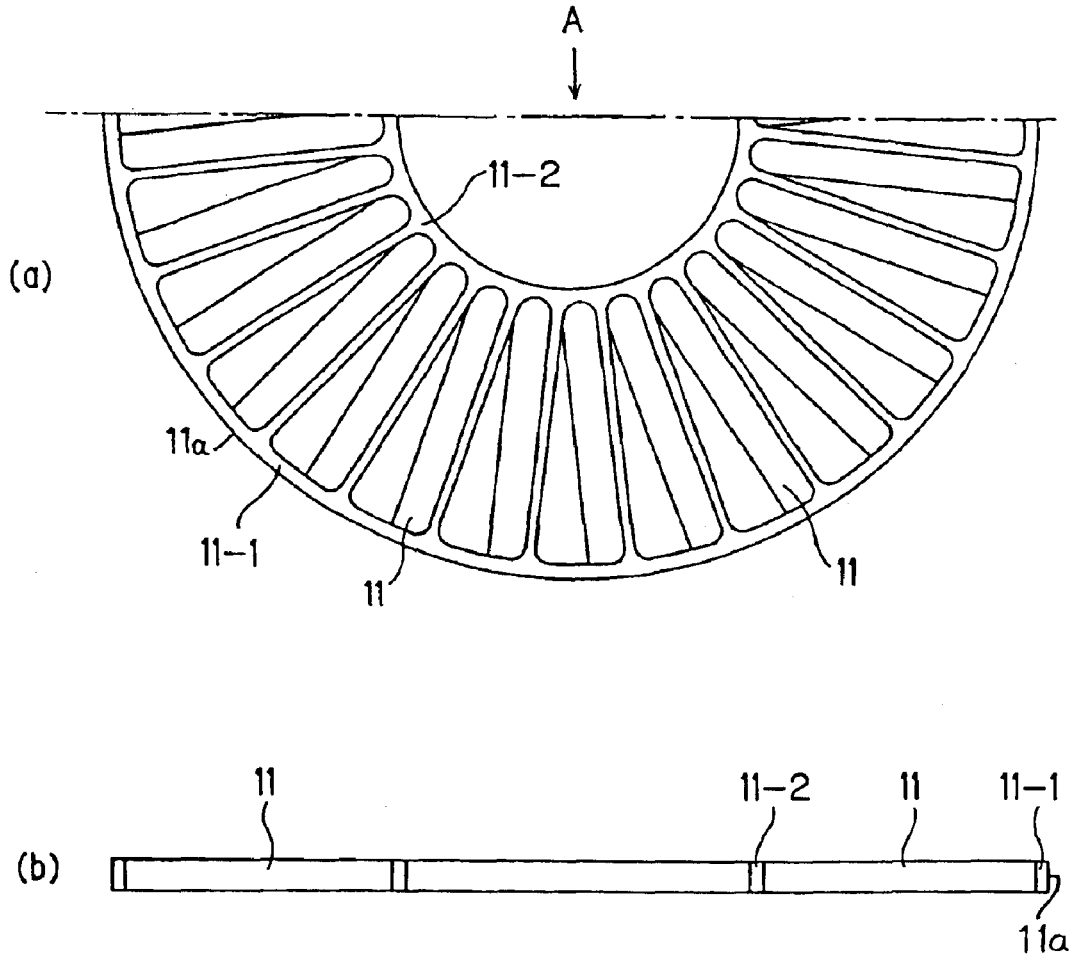
Figure 5:
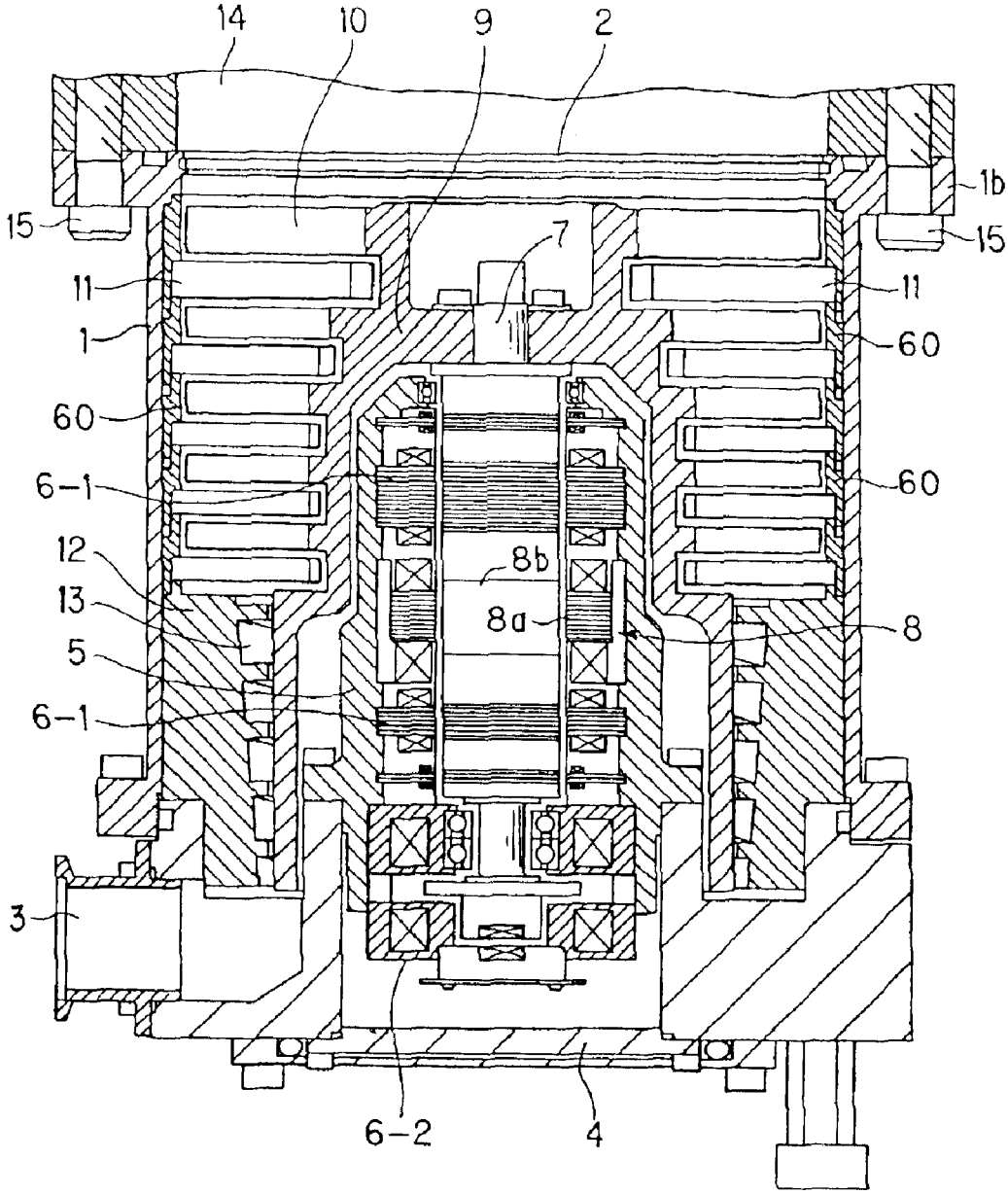
FIG. 5 is a cross-sectional view of a related-art vacuum pump.

In this embodiment, since the radially arranged plurality of stator blades 11 are connected with each other through semicircular arc-shaped inner and outer flange portions 11-1 and 11-2, as shown in FIGS. 4A and 4B, an outer periphery 11*a* of the stator blades 11 means the outer periphery of the outer flange portion 11-1 of the stator blades 11. Without the outer flange portion 11-1, the outer periphery 11*a* itself serves as an outer periphery that surrounds the stator blades 11. The outer periphery portion 11*a* of the stator blades 11 forms a straight outer cylindrical surface. The word "straight" outer cylinder means a non-tapered cylinder in the present invention.

The spacing between each two adjacent upper and lower stator blades 11 is maintained constant by means of an intermediate spacer 50.

Figure 6:
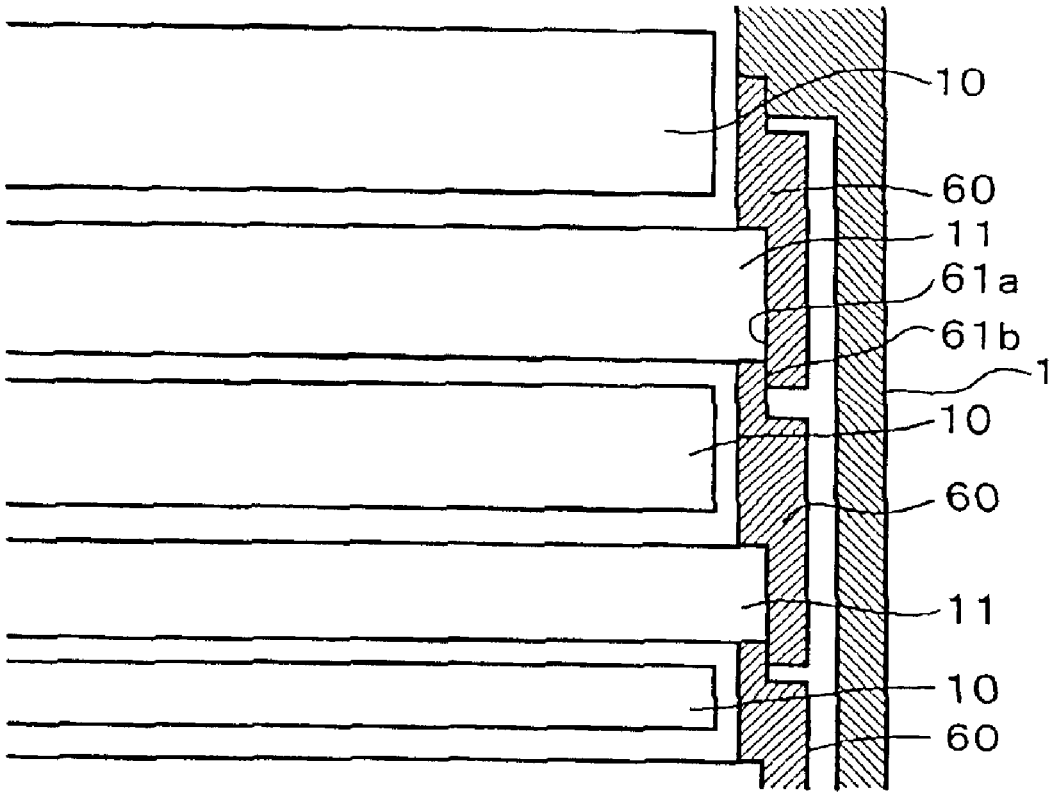
FIG. 6 is an enlarged view of the periphery of spacers of the related-art vacuum pump in FIG. 5.

The spacers 50 do not have the steps (refer to reference numerals 61*a* and 61*b* in FIG. 6) mentioned in the related art, and so they function only to set the spacing between the upper and lower stator blades 11. All of the spacers 50 have a simple ring shape along the inner periphery portion of the pump case 1, more specifically, a ring having a wall with a rectangular cross section.

Since the spacers 50 are arranged completely apart from each other, the spacing between the stator blades 11 is simply determined depending on the height of the spacer 50, and the height of the spacer 50 can easily be adjusted when it is fabricated.

As shown in FIG. 2, the spacers 50 have outer peripheries 50*a* in contact with the inner periphery portion 1*a* of the pump case 1, which allows all the spacers 50 to be fixed to the pump case 1 in the radial direction. The outer peripheries portion 50*a* of the spacers 50 form a straight outer cylindrical surface and the inner periphery portion 1*a* of the pump case 1 forms a straight inner cylindrical surface. The upper and lower end surfaces of each spacer 50 form planes perpendicular to the outer cylindrical surface 50*a*, thus facilitating arrangement of the spacers 50 in the radial direction, and also facilitating arrangement of the stator blades 11 and the spacers 50 in the axial direction, which will be discussed later.

The diameter of the outer periphery portion 11*a* of each stator blade 11 is equal to that of the outer periphery portion 50*a* of each spacer 50, and the stator blades 11 and the spacers 50 are alternately fitted to the inner periphery portion 1*a* of the pump case 1, with the adjacent spacers 50 sandwiching one stator blade 11.

In other words, each stator blade 11 has the outer periphery portion 11*a* in contact with the inner periphery portion 1*a* of the pump case 1, and accordingly, all the stator blades 11 are fixed to the pump case 1 in the radial direction.

This embodiment adopts a structure in which the stator blades 11 are arranged in the radial direction of the pump case 1 such that the inner periphery portion 1*a* of the pump case 1 and the outer peripheries 11*a* of the stator blades 11 are in contact with each other, and a structure in which the spacers 50 are arranged in the radial direction of the pump case 1 such that the inner periphery portion 1*a* of the pump case 1 and the outer periphery portions 50*a* of the spacers 50 are in contact with each other.

Accordingly, even if the vacuum pump of this embodiment adopts the simplified spacers 50, sufficient positioning accuracy of the spacers 50 and the stator blades 11 in the radial direction in the pump case 1 can be ensured owing to the above-described positioning structure.

A screw stator 12 is provided at the outer periphery of the rotor 9 in the lower part of rotor blades 10 and the stator blades 11. The screw stator 12 has an outer periphery shaped in the form of a cylinder that surrounds the lower outer periphery of the rotor 9 and an inner periphery shaped like a tapered cone that become smaller in diameter toward the lower part. The tapered surface has a thread groove 13.

The outer periphery portion 12*a* of the screw stator 12 forms a straight outer cylindrical surface with a diameter equal to those of the outer periphery portion (outer cylindrical surface) 11*a* of the stator blade 11 and the outer periphery portion (outer cylindrical surface) 50*a* of the spacer 50 and is fitted in the inner periphery portion 1*a* of the pump case 1.

Among the multiple-stage spacers 50, a spacer 50-1 that is arranged most distant from the screw stator 12 is in contact with a step 1*c* of the inner periphery portion 1*a* of the pump case 1, thereby the positioning of the stator blades 11, the spacers 50, and the screw stators 12 along the rotor shaft becoming effective.

In other words, a simplified structure is provided in which the outer periphery 11*a* of the stator blades 11, the outer periphery 50*a* of the spacers 50, and the outer periphery portion 12*a* of the screw stators 12 have an equal diameter and they are fitted in the straight inner periphery portion 1*a* of the pump case 1, thereby facilitating processing of parts, assembly, and adjustment.

The pump case 1 has a flange 1*b* around the upper rim, which is brought into contact with the rim of the opening in the lower surface of a process chamber (hereinafter, referred to as a chamber) 14 and in which a plurality of fastening bolts 15 that passes through the flange 1*b* is screwed into the chamber 14 to connect the pump case 1 to the chamber 14.

When the vacuum pump shown in FIG. 1 is assembled, the spacers 50 and the stator blades 11 are alternately stacked in multiple stages in advance, and the pump case 1 is then placed over the stack of the spacers 50 and the stator blades 11 to cover them. When the pump case 1 is mounted, however, lateral displacement of the stack of spacers 50 and stator blades 11 does not cause a problem of obstructing the mounting operation of the pump case 1. This is because the vacuum pump of FIG. 1 is a composite vacuum pump, wherein the stator blades 11 and the rotor blades 10 are arranged only at the upper outer periphery of the rotor 9, the number of stacked stages of the stator blades 11 and the spacers 50 being smaller than that of the full-blade vacuum pump.

The operation of the vacuum pump shown in FIG. 1 will be described. With this vacuum pump, when an auxiliary pump (not shown) connected to the exhaust port 3 is first operated to evacuate the chamber 14 to some extent and the drive motor 8 is then activated, the rotor shaft 7, the rotor 9 connected the rotor shaft and the rotor blades 10 are rotated at high speed.

The high-speed uppermost rotor blade 10 imparts a downward momentum to gas molecules emitted through the inlet 2, and the gas molecules having the downward momentum are guided and sent to the next-stage stator blade 11. The application of the momentum to the gas molecules and the feeding operation are repeated in multiple stages, and accordingly, the gas molecules near the gas inlet 2 are moved in sequence to the inside of the screw stator 12 at the lower part of the rotor 9 and are thereby exhausted. The gas-molecule evacuation operation is thus performed by the interaction of the rotor blades 10 and the stator blades 11.

The gas molecules that have reached the screw stator 12 at the lower part of the rotor 9 by such a molecule evacuation operation, are moved toward the gas exhaust port 3 by the interaction of the rotating rotor 9 and the thread groove 13 formed inside the screw stator 12 while being compressed from a intermediate flow to a viscous flow, and are exhausted to the exterior through the auxiliary pump (not shown) from the gas exhaust port 3.

The vacuum pump according to the above-described embodiment adopts a radial directional positioning structure in which the stator blades 11 and the spacers 50 are arranged in the radial direction of the pump case 1 by the contact between the outer periphery portions of the stator blades 11 and the inner periphery portion of the pump case 1 and the contact between the outer periphery portions of the spacers 50 and the inner periphery portion of the pump case 1. Accordingly, the spacers 50 interposed between the upper and lower stator blades 11 may have a simplified shape that functions only to set the spacing between the stator blades 11 to a prescribed length, thus decreasing the number of steps and costs of processing the spacer 50, and accordingly reducing the costs of the entire vacuum pump.

As shown in FIG. 3, the spacers 50 each have an upper end surface 52, an inner peripheral surface 53 and a lower end surface 54. The step 51 of each stator 50 is defined by the inner peripheral surface 53 and the lower end surface 54. The outer peripheries 11*a* of the stator blades 11 contact the inner peripheral surfaces 53 to position or set the stator blades 11 in radially spaced relation with respect to the inner periphery 1*a* of the pump case 1. In other words, the step 51 of each spacer 50 forms a downwardly, axially extending projection 55 defined by the inner peripheral surface 53 and the outer peripheral surface 50*a*, and the projections 55 position the stator blades 11 in the radial direction relative to the inner periphery 1*a* of the pump case 1. The inner ends of the stator blades 11 are sandwiched between the upper end surfaces 52 of lower spacers 50 and the lower end surfaces 54 of upper spacers 50 to position or set the stator blades 11 in axially spaced relation with respect to one another.

In the embodiment, an example of adopting simplified spacers 50 that have a function of only setting the spacing between the upper and lower stator blades 11 is given, however, the spacers 50 of FIG. 3 may be adopted. Although the spacers 50 of FIG. 3 are the same as the spacers 50 of FIG. 1 in that each of them is shaped like a ring around the inner periphery of the pump case 1 and is interposed between the upper and lower stator blades 11, they are different from the spacers 50 of FIG. 1 in that they also function to arrange and position the stator blades 11 in the radial direction of the pump case 1 in addition to the function of setting the axial spacing between the stator blades 11.

Each of the spacers 50 of FIG. 3 has a step 51 at the inner periphery of the ring, the stator blade 11 being arranged and positioned in the radial direction of the pump case 1 by the contact of the stator blade 11 with the step 51. With the spacers 50 of FIG. 3, the stator blades 11 are arranged in the radial direction of the pump case 1 by means of the spacers 50. Accordingly, it is sufficient to adopt a radial directional positioning structure in which the spacers 50 themselves are arranged in the radial direction of the pump case 1 by the contact between the inner periphery portion 1*a*of the pump case 1 and the outer peripheries 50*a* of the spacers 50.

For manufacturing the spacer 50 of FIG. 3, the step has only to be cut in one side (inner periphery) of the ring and it is not necessary for the step to be cut in the other side (outer periphery) of the ring. Therefore, defects due to deformation of the ring can be prevented and the number of steps and work required to process the spacers 50 can be reduced, thus reducing the costs of the entire vacuum pump.

The top surface 50*b* of the spacer 50 forms a plane perpendicular to the outer periphery 50*a*.

The vacuum pump according to the present invention adopts a radial positioning structure in which the stator blade and the spacer are arranged in the radial direction of the pump case by the contact between the outer periphery portion of the stator blade and the inner periphery portion of the pump case and the contact between the outer periphery portion of the spacer and the inner periphery portion of the pump case. Accordingly, the spacer may have a simplified shape that functions only to set the spacing between the stator blades to a prescribed length, thus decreasing the number of steps and costs of processing the spacer, and accordingly reducing the costs of the entire vacuum pump.

The vacuum pump according to the invention adopts a radial positioning structure in which the spacer is arranged in the radial direction of the pump case by the contact between the outer periphery portion of the spacer and the inner periphery portion of the pump case. Accordingly, the spacer may have a relatively simplified shape that has only a function of setting the spacing between the stator blades to a prescribed length and a function of arranging the stator blade in the radial direction of the pump case, thus decreasing the number of steps and costs of processing the spacer, and accordingly reducing the costs of the entire vacuum pump.

What is claimed is:

1. A vacuum pump comprising:

a cylindrical pump case;

a rotatable rotor mounted to undergo rotation inside the pump case;

multistage stator blades arranged alternately with the rotor blades inside the pump case;

ring-shaped spacers arranged on the inner periphery of the pump case, each of the spacers being interposed between an adjacent pair of upper and lower stator blades and having upper and lower end surfaces in contact with the upper and lower stator blades to space the stator blades in the axial direction of the rotor and having outer and inner peripheral surfaces which position the stator blades in the radial direction of the rotor, the outer peripheral surface contacting the inner periphery of the pump case and the inner peripheral surface partially contacting an outer periphery of one of the upper and lower stator blades, and each two adjacent spacers being spaced apart from one another in the axial direction of the rotor by tone of the stator blades; and a screw stator surrounding the lower outer periphery of the rotor.

2. A vacuum pump according to claim 1; wherein the outer periphery portions of the spacers define a straight cylindrical surface, at least one end surface thereof defining a plane perpendicular to the straight cylindrical surface.

3. A vacuum pump according to claim 1; wherein each of the spacers has a step at the inner periphery thereof, one surface of the step comprising the lower end surface and another surface of the step comprising the inner peripheral surface.

4. A vacuum pump according to claim 1; wherein the spacers are spaced apart from one another a distance less than the vertical dimension of the stator blades with which the spacers are in contact.

5. A vacuum pump comprising: a pump case having an inner periphery; a rotor rotatably mounted inside the pump case; multistage rotor blades connected to an upper portion of the rotor, the rotor blades being axially spaced apart in an axial direction of the pump case and extending radially outwardly in a radial direction of the pump case; multistage stator blades disposed in an upper portion of the pump case, the stator blades extending radially inwardly and being arranged alternately with the rotor blades; and a plurality of axially spaced, non-contacting spacers interposed between respective pairs of adjacent upper and lower stator blades to position the stator blades both in axially spaced relation with respect to one another and in radially spaced relation with respect to the inner periphery of the pump case.

6. A vacuum pump according to claim 5; wherein the spacers extend circumferentially around and contact the inner periphery of the pump case.

7. A vacuum pump according to claim 6; wherein each spacer has an upper end surface in contact with an upper stator blade and a lower end surface in contact with a lower stator blade.

8. A vacuum pump according to claim 7; wherein each stator blade is sandwiched between the upper end surface of a lower spacer and the lower end surface of an upper spacer to thereby axially position the stator blade, and wherein each spacer has a downwardly extending projection sandwiched between an outer peripheral surface of a lower stator blade and the inner periphery of the pump case to thereby radially position the stator blade.

9. A vacuum pump according to claim 8; wherein the spacers are ring-shaped and have outer peripheries in contact with the inner periphery of the pump case.

10. A vacuum pump according to claim 6; wherein each spacer has an axially extending projection interposed between an outer peripheral surface of one stator blade and the inner periphery of the pump case to position the stator blade in radially spaced relation with respect to the inner periphery of the pump case.

11. A vacuum pump according to claim 10; wherein the spacers are ring-shaped and have outer peripheries in contact with the inner periphery of the pump case.

12. A vacuum pump according to claim 5; wherein each spacer has an axially extending projection interposed between an outer peripheral surface of one stator blade and the inner periphery of the pump case to position the stator blade in radially spaced relation with respect to the inner periphery of the pump case.

13. A vacuum pump according to claim 12; wherein the spacers are ring-shaped and have outer peripheries in contact with the inner periphery of the pump case.

14. A vacuum pump according to claim 5; wherein the spacers are ring-shaped and have outer peripheries in contact with the inner periphery of the pump case.

15. A vacuum pump according to claim 5; further including a screw stator disposed in a lower portion of the pump case and encircling the lower outer periphery of the rotor.

16. A vacuum pump according to claim 5; where in the inner periphery of the pump case is cylindrical, and wherein the spacers have outer peripheries which define a cylindrical surface and which contact the cylindrical inner periphery of the pump case.

* * * * *